US005259703A

United States Patent [19]

Gillespie

[11] Patent Number: 5,259,703

[45] Date of Patent: Nov. 9, 1993

[54] MINE ROOF BOLT

[76] Inventor: Harvey D. Gillespie, 4848 S. 2200 West, Salt Lake City, Utah 84118

[21] Appl. No.: 10,357

[22] Filed: Jan. 28, 1993

Related U.S. Application Data

[63] Continuation-in-part of Ser. No. 865,371, Mar. 23, 1992.

[51] Int. Cl.[5] ..... E21D 21/02

[52] U.S. Cl. ..... 405/259.6; 405/259.1; 405/302.2

[58] Field of Search ..... 405/259.1–259.6, 405/302.2

[56] References Cited

U.S. PATENT DOCUMENTS

| | | | |
|---|---|---|---|
| 2,850,937 | 9/1958 | Ralston | 85/62 |
| 3,650,112 | 3/1972 | Howlett et al. . | |
| 4,140,428 | 2/1979 | McLain et al. | 405/261 |
| 4,449,855 | 5/1984 | Langwadt | 405/260 |
| 4,648,753 | 3/1987 | Stephen | 405/260 |
| 4,724,639 | 2/1988 | Moser | 52/233 |
| 4,798,501 | 1/1989 | Spies | 405/260 |
| 4,832,534 | 5/1989 | Duvieusart | 405/261 |
| 4,884,377 | 12/1989 | Matt | 52/98 |

*Primary Examiner*—Dennis L. Taylor
*Attorney, Agent, or Firm*—Prince, Yeates & Geldzahler

[57] ABSTRACT

A passive-type mine roof bolt is constructed of multi strand steel cable. The bolt head is constructed of a hexagonal- or other drive-headed collar having an internally tapered funnel-shaped bore therethrough, and a tapered plug having a frusto-conical outer surface that engages the funnel-shaped inner surface of the drive collar. The tapered plug has an internal bore essentially concentric with the outer frusto-conical surface, and is adapted to fit over the steel cable, the hexagonal head drive collar fitting over the tapered plug such that pressing the tapered plug and steel cable into the inner funnel-shaped bore of the hexagonal-head drive collar causes serrations on the internal bore of the tapered plug to be urged down against, and bite into, the steel cable, resulting in a rigid hexagonal head for the cable bolt. The tapered plug is in actuality, a pair of essentially identical diametrically opposed semi-frusto-conical tapered sections that more easily compress together to bite into the multi-strand steel cable. A number of alternative embodiments enhance the bolt's retention strength in the bore hole to aid in stabilizing the rock formation.

15 Claims, 7 Drawing Sheets

MINE ROOF BOLT

RELATED APPLICATION

This application is a continuation-in-part of my copending application entitled Mine Roof Bolt, Ser. No. 07/865,371, filed Mar. 23, 1992, because the parent application has not issued as a patent.

BACKGROUND OF THE INVENTION

1. Field of the Invention

The present invention relates to mine roof bolts, and more particularly relates to mine roof bolts constructed of multi-strand steel cable.

2. Description of the Prior Art

In the art of mine tunnel roof support, there are two major categories of bolting systems wherein mine roof bolts are anchored in bore holes drilled in the mine roof, the bolts' purpose being to reinforce and stabilize the unsupported rock formation above the mine tunnel. These two categories of mine roof bolting systems are: (1) tension-type systems, and (2) passive-type systems. In each system, it is common practice to, first, drill a hole through the mine tunnel ceiling into the rock formation above to a depth appropriate for the type of rock formation to be supported. A mine roof bolt and roof plate are then anchored in the bore hole to support the mine roof and maintain the rock formation in place.

In a common tension-type mine roof bolt system, an expansion shell type anchor is installed on the threaded end of the bolt. The bolt and expansion shell anchor are inserted up into the bore hole until the roof plate is against the mine roof. The bolt is then rotated to thread a tapered plug section of the expansion shell down toward the bolt head, in order to expand the jaws of the expansion shell against the interior wall of the bore hole to thereby hold the mine roof bolt in place within the bore hole, the mine roof bolt functioning to support and stabilize the rock formation above the mine tunnel.

In passive-type mine roof bolt systems, the passive-type bolt is not attached to an expansion shell or similar anchor at the free (upper) end of the bolt, but rather is retained in place within the rock formation by a rapid curing resin adhesive material that is mixed in the bore hole as the bolt is rotated and positioned within the bore hole. In theory, the resin adhesive bonds the bolt to the rock formation along the total length of the bolt within the bore hole in the rock formation. It is also common practice to use resin adhesive with a tension-type mine roof bolt to retain the bolt within the mine roof bore hole, at least along the upper portion of the bolt.

In passive-type and some tension type mine roof bolt systems, one or more resin cartridges are inserted into the bore hole prior to (ahead of) the mine roof bolt. Forcing the mine roof bolt into the bore hole while simultaneously rotating the bolt ruptures the resin cartridge(s) and mixes the resin components within the annulus between the bolt shank and bore hole wall. Ideally, the resin adhesive mixture totally fills the annulus between the bolt shank and bore hole wall at least along the upper portion of tension-type bolting systems, and along the total length of the bolt shank and bore hole wall in passive type systems. The resin mixture is forced into cracks and crevices in the bore hole wall and into the surrounding rock formation to adhere the bolt to the rock formation.

When extremely long mine roof bolts are necessary, it is common practice to attach two or more bolt shank sections together by couplers to result in a "roof bolt" of sufficient length appropriate for the particular type of rock formation. These couplers between bolt sections, being of a larger diameter than the bolt shanks, prevent the mixed resin adhesive from flowing downwardly (resin return) within the bore hole annulus from the first (upper) bolt section to the lower section(s). Therefore, the effective anchoring of the bolt to the bore hole wall within the rock formation is, essentially, only along the length of the first (upper) bolt section wherein the resin adhesive totally fills the annulus between the bolt section and the bore hole wall.

To alleviate this problem, it has been common practice simply to drill a larger bore hole in the rock formation that will enable the resin adhesive to flow around the coupler(s) as the bolt is being inserted into and rotated within the bore hole to mix the resin. Although this does effect the desired result (resin return around the coupler(s) within the annulus between the bolt shank and bore hole wall), it creates another problem that, depending on the type of rock formation, may be more dangerous than the problem that is corrected by a larger bore hole. Specifically, the bonding effectiveness of the resin adhesive material to hold the mine roof bolt in place within the bore hole is considerably weakened by virtue of the increased distance between the bolt shank and bore hole wall, and the sheer volume of resin adhesive material necessary to totally fill the annulus. Additionally, by virtue of their specific makeups, mine roof rock formations that actually require long (fifteen feet or longer) mine roof bolts are more susceptible to movement and shifting within the rock formation, than are more solid rock formations that require only shorter mine roof bolts.

Another common problem with using mine roof bolt sections coupled together in such rock formations that require longer (coupled) mine roof bolts, this shifting of the rock formation (shear) causes the bolt couplers to fracture. When this happens, of course, the effective holding length of the mine roof bolt is instantly decreased. In many instances, there is no or very little resin adhesive material around the broken bolt shank to help stabilize the rock formation. Therefore, in almost all instances, this shortened mine roof bolt is ineffective to safely prevent the mine roof rock formation from further shifting and potential collapse.

It is therefore an object of the present invention to provide an improved mine roof bolt that does not require an oversized mine roof bore hole in order to effect full and complete resin return within the annulus between the bolt shank and bore hole wall along the total length of the bolt shank.

It is another object of the present invention to provide an improved mine roof bolt that is available in various lengths without the use of bolt shank couplers that are susceptible to fracture when the mine roof rock formation shifts.

It is a further object of the present invention to provide an improved mine roof bolt having an outer surface that aids in effecting complete mixture of the resin adhesive material, and also includes crevices within the mine roof bolt shank that permit penetration of the resin bonding material into the bolt shank for more effective resin bonding thereto.

It is a still further object of the present invention to provide an improved mine roof bolt that will easily bend for installation into a bore hole that is considerably deeper than the height of the mine tunnel at the installation location, and will also bend with a shifting rock formation, and fully retain its bonding within the rock formation along the total length of the mine roof bolt without breaking when the rock formation shifts.

It is yet another object of the present invention to provide an improved mine roof bolt that includes means for preventing voids in the mixture of resin adhesive material in the annulus surrounding the bolt shank.

It is a further object of the present invention to provide an improved mine roof bolt that includes means for preventing premature rupture of resin cartridges while positioning the cartridges into the bore hole.

It is yet a further object of the present invention to provide an improved mine roof bolt that includes means on the bolt shank for preventing voids in the resin adhesive material, such means also permitting the resin adhesive to flow around and under the means to further support the mine roof bolt and the rock formation.

It is a still further object of the prevent invention to provide an improved mine roof bolt having means for protecting the bolt shank from abrasive wear from the roof plate as the bolt is being spun into the bore hole.

It is another object of the present invention to provide an improved mine roof bolt having means for permitting the bolt to "yield" within the bore hole at a consistent yielding force as shifting of the rock formation tends to cause the bolt shank to "slip" relative to the resin adhesive.

It is still another object of the present invention to provide an improved mine roof bolt having means for preventing the bolt heads from falling from the bore hole, in the event the bolt fails under extreme load.

SUMMARY OF THE INVENTION

The improved mine roof bolt of the present invention is constructed of a length of pre-tensioned, multi-strand steel cable, commonly formed of six individual pre-tensioned steel strands spirally wrapped around a seventh steel strand. The head of the bolt is formed by positioning a two-piece tapered plug around the stranded steel cable at one end, and then slipping a hexagonal- or other drive-headed internally tapered collar around the tapered plug. Pressing the internally tapered hexagonal head collar down around and against the two-piece tapered plug urges serrations on the interior circumference of the plug sections to "bite" into the stranded steel cable to form a rigid hexagonal bolt head on the cable that further tightens against the steel strands as tension is applied to the mine roof bolt.

The mine roof bolt includes a number of embodiments that enhance its ability to be retained within the bore hole, and therefore, to stabilize the rock formation. "Buttons" or sleeves swaged on the shank cable effect improved bonding of the resin adhesive to the bolt shank. An annualar dam around the bolt shank retains the resin adhesive around the shank, minimizes voids and air pockets in the resin, and forces the resin into cracks and crevices in the rock formation. A stiffner sleeve prevents cable buckle as the bolt is being urged into the bore hole and also protects the cable from abrasive wear from the mine roof plate as the bolt is being spun into the bore hole. A resin protector cap protects resin cartridges from premature rupture by the sharp end of the bolt shank cable, and retains the resin cartridges in place within the bore hole when the bolt is subsequently withdrawn. A plurality of cap sleeves fit over the bolt heads and are interconnected in a manner to contain bolts that break within the bore hole.

Lastly, a "yieldable" cable bolt design incorporates means that permit the bolt shank to slip or "yield" relative to the resin adhesive within the bore hole while maintaining a consistent resistance force along the shank, even as the shank is pulled outwardly from the bore hole and out of contact with the resin adhesive.

DESCRIPTION OF THE PREFERRED EMBODIMENT

Figure 1:
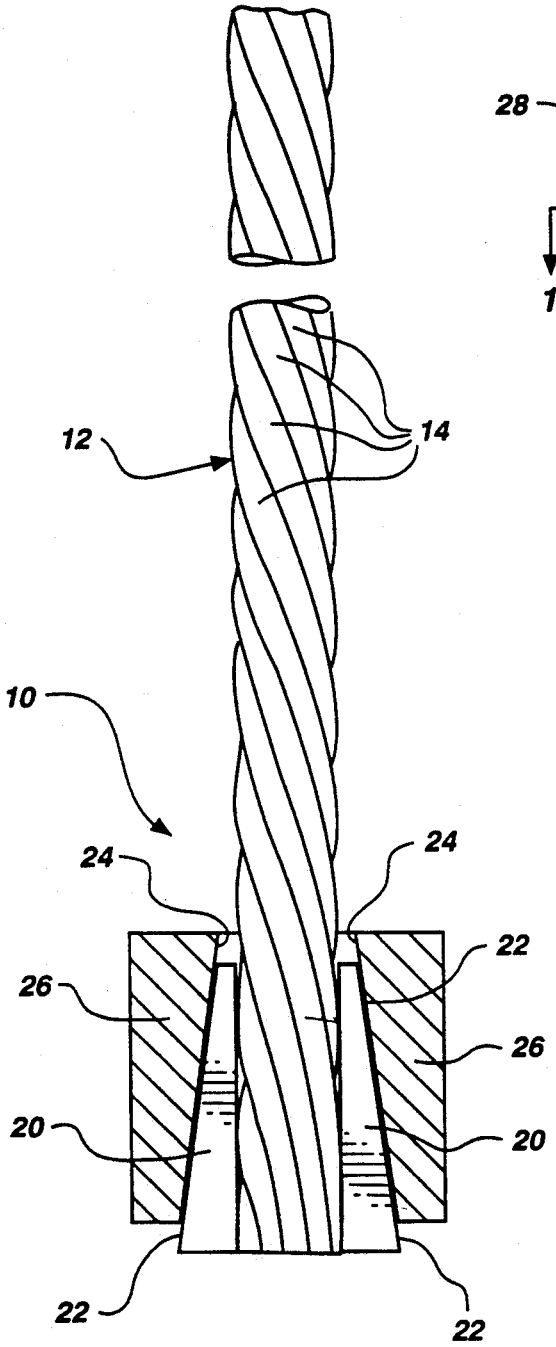
FIG. 1 is a partial sectional view of the improved mine roof bolt of the present invention, illustrating the two-piece tapered plug and, in section, the internally tapered hexagonal head collar.

Referring now to the drawings, and initially to FIG. 1, the improved mine roof bolt is shown, generally illustrated by the numeral 10. The mine roof bolt comprises a shank 12 made up of a length of pre-tensioned steel stranded cable, which in the embodiment shown, is made up of six peripheral pre-tensioned steel strands 14 spirally wrapped around a central steel strand 16 (more clearly shown in FIG. 2).

At one end of the steel stranded cable is affixed a two-piece tapered plug 20 which comprises two identical diametrically opposed essentially half-cylinders that define the outer surface of a right conical frustum. The frusto-conical outer surface 22 of the two piece tapered plug 20 is designed to engage a mating inside funnel surface of an internally tapered hexagonal head collar 26. Although the collar 26 is shown as a hexagonal head, obviously a square head or any other shaped head that accepts a mine roof bolt driver mechanism and boom should function adequately for the intended purpose.

Figure 2:
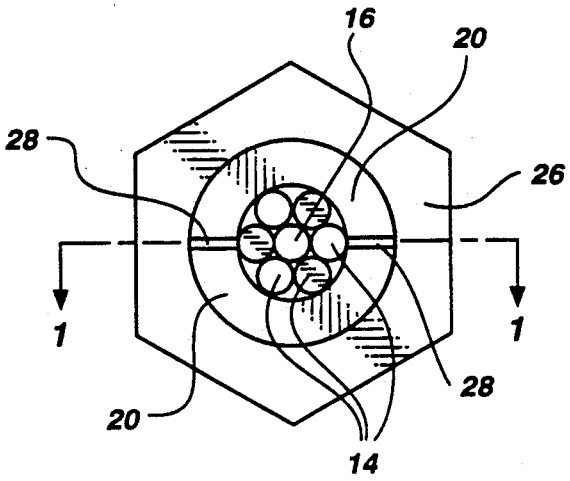
FIG. 2 is an end view of the improved mine roof bolt.

FIG. 2 is an end view of the improved mine roof bolt of the present invention, and illustrates how the two-piece tapered plug fits concentrically around the pretensioned steel cable shank of the bolt, and also nests concentrically within the internally tapered hexagonal head collar 26. Note that the individual sections of the two-piece tapered plug 20 are not fully semi-frusto-conical. When functionally positioned within the hexagonal head collar 26 and around the steel cable shank 12, the two individual plug sections 20 define a diametric space 28 between the two plug sections to enable the plug sections to be urged together tightly when pressed against the steel stranded cable.

Figure 3:
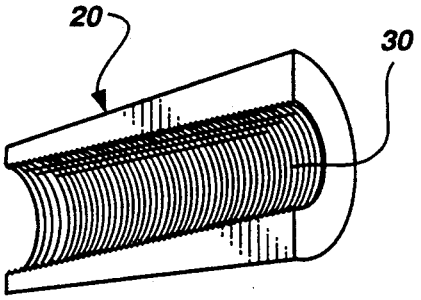
FIG. 3 is a perspective view of one section of a two-piece tapered plug.

FIG. 3 is a perspective view of one section of the two-piece tapered plug 20, and more clearly shows a series of serrations or knurls 30 that define the inner essentially semi-tubular surface of the tapered plug. These serrations 30 are designed to "bite" into the steel cable defining the roof bolt shank 12 as the two-piece tapered plug 20 is urged further into the hexagonal head collar 26 to define the rigid hex-head of the improved mine roof bolt.

Creating this rigid hex-head on the mine roof bolt can be accomplished in either of two ways: (1) By pressing the two-piece tapered plug 20 and steel cable shank 12 into the hexagonal head collar 26 as the mine roof bolt is factory-manufactured; or (2) After having cut the steel cable to the desired length at the mine site, assembling the steel cable, two-piece tapered plug 20, and hexagonal head collar 26, and then tensioning the steel cable against the hexagonal head collar, or otherwise pressing the tapered plug and cable into the collar. In either instance, the "head" of the improved mine roof bolt 10 should be rigid and secure sufficiently to remain intact as the mine roof bolt is being inserted into the bore hole, forced up into the bore hole against the resin cartridge(s), and rotated or spun within the bore hole in order to rupture the resin cartridge(s) and mix and distribute the resin adhesive material.

Figure 4:
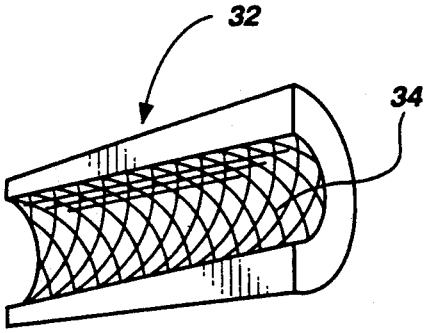
FIG. 4 is a perspective view of an alternative embodiment of one section of a two-piece tapered plug.

FIG. 4 is a perspective view of one section of an alternative embodiment of the two-piece tapered plug, shown at 32. This alternative embodiment tapered plug includes a different type of knurl 34 formed in a diamond pattern resulting from diagonally oriented serrations. Those skilled in the art will appreciate that this diamond pattern knurl will better retain the tapered plug 32 on the steel cable against both torsion as the improved mine roof bolt 10 is rotated during installation, and against tension as the bolt remains in place within mine roof rock formation to retain the rock formation in place.

Figure 5:
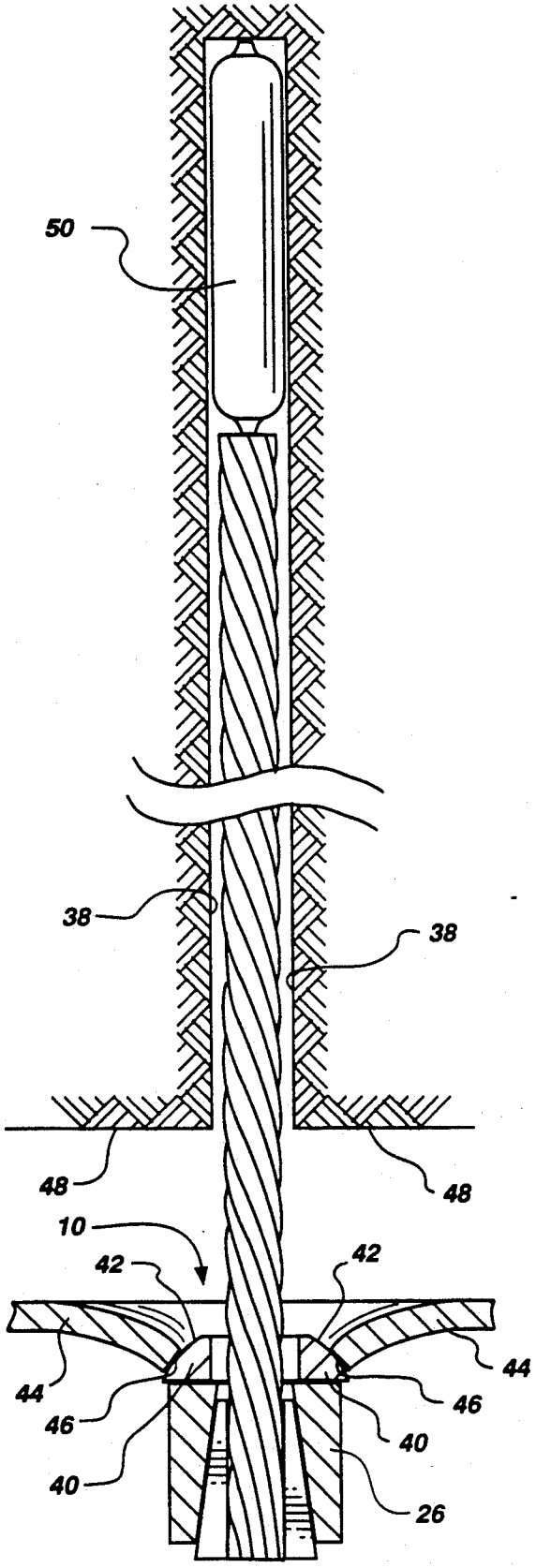
FIG. 5 is a side elevation view of the improved mine roof bolt positioned in the mine roof bore hole under the resin cartridge, the mine roof plate, spherical washer, and internally tapered hexagonal head being shown in section.

FIG. 5 illustrates the improved mine roof bolt and its arrangement as inserted up into a mine tunnel roof bore hole. Assuming that the improved mine roof bolt has previously been assembled as shown in FIG. 1, and the two-piece tapered plug 20 has been pressed into the hexagonal head collar 26 to define a rigid bolt head, the user first places a spherical washer 40 having a partial spherical surface 42 over the bolt shank and down against the hexagonal head collar 26, as shown. Next, the user slips on a dome mine roof plate 44, the through-hole of the roof plate having an angled surface 46 that mates with the partial spherical surface 42 of the spherical washer 40.

Those skilled in the art will appreciate that this spherical washer 40 and the angled surface 46 of the dome mine roof plate 44 define a "ball and socket"-like arrangement that permits the improved mine roof bolt and dome mine roof plate to be used in mine tunnel roofs wherein (1) the bore holes are angled or otherwise not normal to the surface of the mine ceiling 48, (2) the mine ceiling surfaces are extremely rough or otherwise uneven, or (3) a combination of (1) and (2) that results in the entrance to the mine roof bore hole not being exactly normal to the mine ceiling surface at the location of the bore hole. Additionally, such an arrangement permits the improved mine roof bolt 10 to shift slightly as the rock formation above shifts, and still maintain an essentially uniform force distribution against the dome mine roof plate 44.

To this end, the inventor has determined that, alternatively, the hexagonal head 26 of the improved mine roof bolt of the present invention and the spherical washer 40 may be formed as a single piece. This simplifies installation and more easily maintains the mine roof bolt in alignment with the roof plate during insertion and rotation of the mine roof bolt in the roof bore hole.

Figure 6:
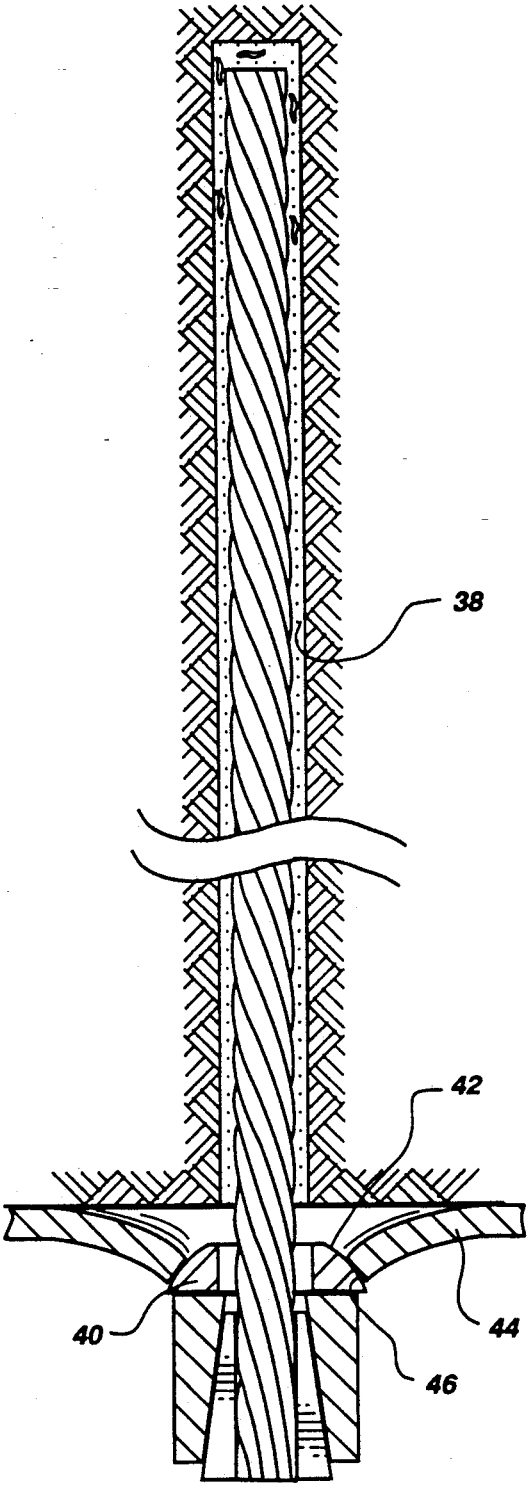
FIG. 6 is a view of the improved mine roof bolt of FIG. 5, shown in installed position within the mine roof bore hole, with the resin adhesive material thoroughly mixed and completely filling the annulus around the shank of the mine roof bolt.

The spherical washer 40 and dome mine roof plate 44 having been installed on the improved mine roof bolt 10, the user then inserts a resin cartridge 50 into the bore hole 38, followed by the improved mine roof bolt of the present invention. The user then forces the bolt 10 upwardly into the bore hole 38 under the force of the bolter boom (not shown), while simultaneously rotating the bolt to rupture the resin cartridge 50 and thoroughly mix and distribute the resin adhesive material contained therein. Continued rotation of the mine roof bolt 10 after the dome mine roof plate 44 has been urged up against the mine tunnel ceiling 48, further mixes and distributes the resin adhesive material within the annulus between the steel cable and the mine roof bore hole 38, and causes the resin adhesive material to be forced into the cracks and crevices within the rock formation, and also into the crevices and spaces between the individual peripheral steel strands 14 of the steel cable. After the resin adhesive material is thoroughly mixed, the assembled bolt is held in place against the mine ceiling 48 as shown in FIG. 6, by the boom, for a period of time sufficient to permit the resin to cure.

Figure 7:
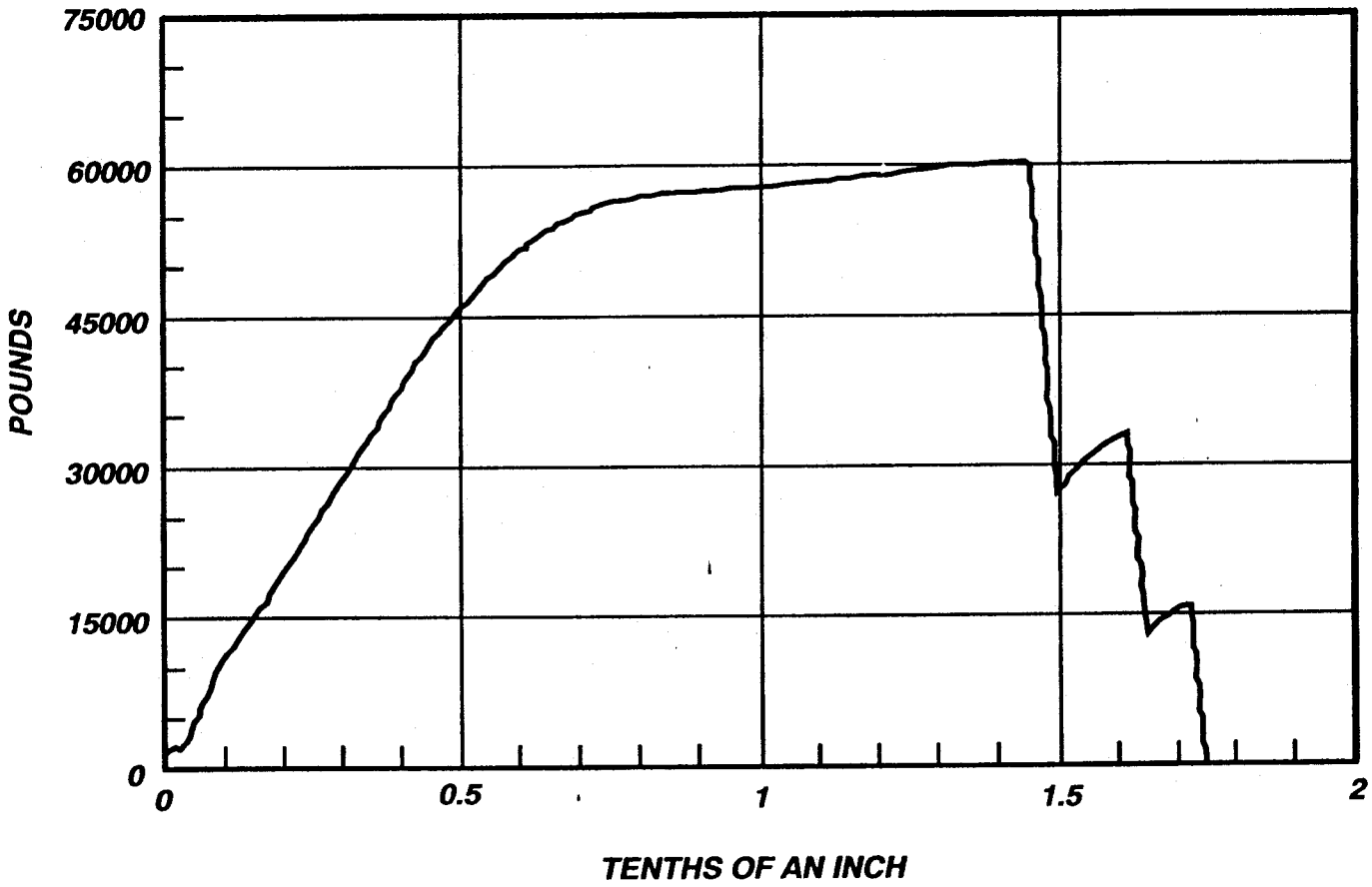
FIG. 7 is a graph of tensile strength vs. elongation for a 9/16 inch diameter improved mine roof bolt of the present invention.

FIG. 7 is a graph of tensile strength vs. elongation for a 9/16 inch diameter cable mine roof bolt of the present invention. When pulled in tension until fracture, the mine roof bolt begins to yield at approximately 57,000 pounds of force, and will withstand over 60,00 pounds of force before fracturing.

As the graph of FIG. 7 illustrates, in testing, the fracture of the seven-strand cable mine roof bolt actually occurs in a stepped progression, rather than all at once. Typically, one, two, or three individual cable strands will fail at approximately 60,000 pounds, the remaining four, five, or six strands remaining intact to continue to support the rock formation above the mine roof. These remaining four to six strands will continue to withstand from 25,000 to 35,000 pounds of force before the next set of one, two, or three strands fails in tension. The steel cable strands remaining intact after the second set of strands fails (from one to four) will continue to withstand approximately 15,000 pounds of force before ultimate total failure of the mine roof bolt.

By comparison, a convential ⅝ inch diameter smooth shank mine roof bolt will fail at under approximately 30,000 pounds of force, approximately one-half of the maximum force of approximately 60,000 pounds that a 9/16 inch diameter cable mine roof bolt will withstand before the initial partial failure.

It is important to note that when the 9/16 inch cable mine roof bolt "fails" at 60,000 pounds, its failure is only partial, in that four to six steel strands remain intact through the first "stepped failure". Therefore, the improved mine roof bolt of the present invention remains intact after initial "failure" to continue to support the rock formation to permit the rock formation to stabilize with the bolt intact and is still able to withstand approximately 30,000 pounds of force before a subsequent "failure" occurs.

The inventor has also determined in testing, that the multi-strand cable defining the shank of the improved mine roof bolt of the present invention fractures adjacent the point of attachment to the two-piece tapered plug, leaving essentially the total length of the steel cable shank remaining in the mine roof bolt bore hole to continue to support the rock formation. This is to be contrasted with conventional mine roof bolts formed of shank sections collared together that generally fracture either at or adjacent a collar. In the event the collar has prevented complete resin return along the total length of the bolt section(s), that portion of the mine roof bolt below the fracture, if not resin bonded into the rock formation, is rendered totally ineffective as structural support, and possibly will even fall out of the bore hole.

It is this aspect of the improved mine roof bolt of the present invention that permits it to better withstand rock formation lateral movement, in that the cable mine roof bolt (1) will not fracture along the shank or coupler (there is no coupler), but will fracture adjacent the hexagonal head, and (2) will remain intact along essentially its total length of the shank within the bore hole, even following a partial "stepped fracture".

Figure 8:
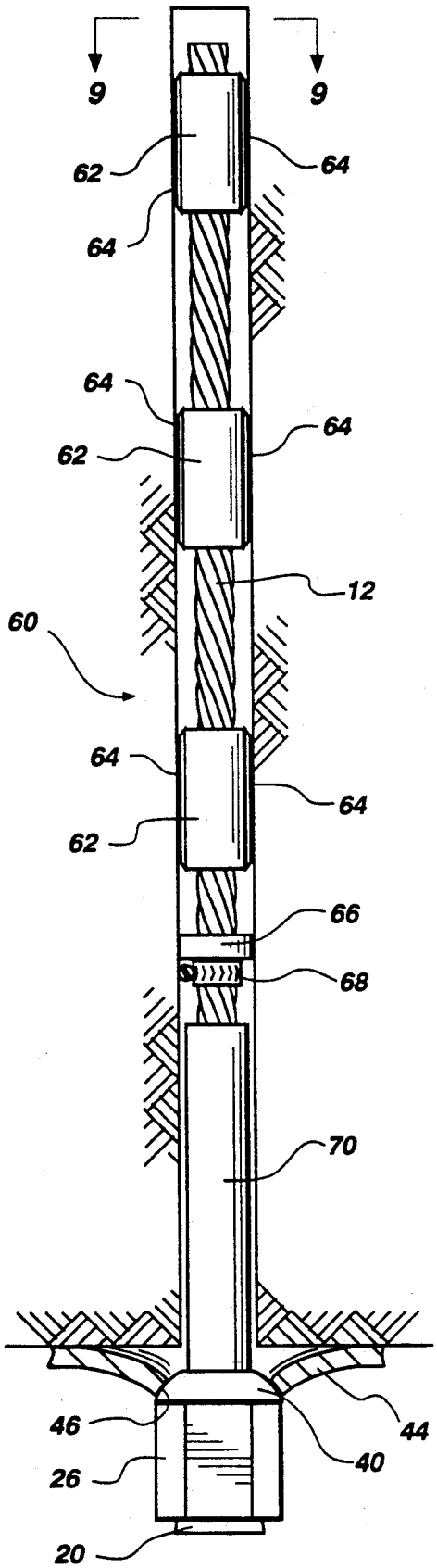
FIG. 8 is a side elevation view of the mine roof bolt of the present invention illustrating a number of alternative embodiments.

FIG. 8 illustrates a number of alternative embodiments in the mine roof bolt of the present invention, generally illustrated at 60. As in the first embodiment of FIGS. 1–7, the mine roof bolt 60 comprises a shank 12 of a length of multi-strand steel cable, which conventionally is made up of six peripheral steel strands 14 spirally wrapped around a central steel strand 16.

At one end of the stranded steel cable is affixed the two-piece tapered plug 20, which comprises the two identical diametrically opposed tapered semi-cylinders that define the outer surface of a right conical frustum. The hexagonal head collar 26 is pressed down upon and around the two-piece tapered plug 20 to define the hexagonal bolt head.

The mine roof bolt 60 includes a number of alternative embodiments that function to enhance its ability to be retained within the bore hole, and therefore to support the rock formation. The first of these retention enhancements defines a second embodiment mine roof bolt, and comprises one or more sleeves or "buttons" 62 attached to the bolt shank 12 at various points along the cable. These cable buttons 62 take the form of steel cylinders that are swaged down upon the bolt shank cable 12. In one embodiment, the steel cylinder has initial dimensions of one inch outside diameter, ⅝ inch inside diameter and one and ½ inches in length. When this cylinder is swaged down upon a 0.600 diameter stranded steel cable with 500 tons of force, it deforms down into the interstices between the individual peripheral steel strands of the shank cable, and is transformed into the cylindrical button 62 having a ⅞ inch outside diameter and a length of approximately two inches.

Figure 9:
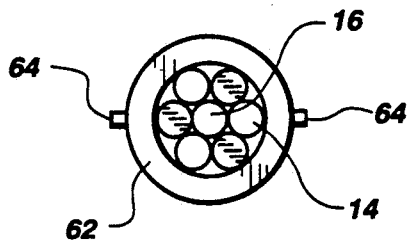
FIG. 9 is an end view of the second alternative embodiment mine roof bolt taken along lines 9—9 in FIG. 8.

The steel cylinder that becomes the cable shank button 62 is swaged onto the cable by a piston-ram swaging device (not shown). The swaging device has a stationary semi cylindrical die, and an opposing semi-cylindrical die mounted on the ram piston for swaging the steel cylinder onto the cable in diametrical fashion. As a practical matter, the two semi-cylindrical dies are not 100% completely semi-cylindrical. The result is that, when the steel cylinder is swaged onto the shank cable, swaging causes some of the cylinder material to be forced radially outwardly between the dies, forming two diametrically aligned ears or fins 64 that are subsequently trimmed down to a symmetric diammetric distance that corresponds to the inside diameter of the mine roof bore hole. This is best shown in FIG. 9. For example, the previously described steel cylinder that is swaged down to a ⅞ outside diameter and two inch long button 62 would have fins 64 approximately 1/32 inch thick and 1/16 inch long (radial dimension) for use in a one inch diameter bore hole. Likewise, the buttons, including the fins, can be made to any outside diameter to accommodate the particular bore hole size. These fins 64 serve to center the bolt shank 12 within the bore hole, and also aid in puncturing the resin cartridge 50 and mixing the resin adhesive within the bore hole as the bolt is being rotated and inserted into the bore hole.

It still may be possible that swaging the buttons 62 onto the cable with 500 tons of force would not totally prevent a button from slipping along the cable under extreme tension, as when the supported rock formation shifts. To minimize the possibility of this happening, shallow threads (not shown) may be cut into the cable at locations where buttons are to be swaged. Swaging the buttons onto these "threaded" areas of the bolt shank cable forces the button material into these threads to minimize, if not totally prevent, any axial movement of the buttons along the cable. As an added measure, the cylinders that become buttons may also be formed with internal threads (not shown) that can easily align with the shallow cable threads as the buttons are being swaged onto the cable. This insures optimum grip between the buttons and the cable.

Once the resin adhesive has been thoroughly mixed and has set within the bore hole, the buttons 62 are surrounded by hardened resin, and it is then virtually impossible to retract the mine roof bolt from the bore hole. This is because the resin has worked itself into the cracks and crevices within the rock formation in the bore hole, and has also surrounded each of the buttons 62 along the length of the bolt shank cable, forming a barrier of solid resin around and below the button and into the rock formation.

FIG. 8 also illustrates a third embodiment of the mine roof bolt of the present invention that can be used either by itself or in conjunction with one or more of the buttons 62 along the shank of the bolt. Specifically, the third embodiment bolt includes a dam 66 mounted on the bolt shank 12. A preferred and simple construction of this dam 66 takes the form of a plastic or rubber washer of the appropriate outside diameter (1 inch in a 1-inch diameter bore hole, for example), and an inside diameter appropriate to enable the washer 66 to fit snugly around the bolt shank 12. A washer 66 of approximately ¼ inch thick is appropriate to achieve its intended function, that being to retain the mixed liquid resin adhesive within the bore hole along the entire length of the bolt shank above the dam in order to improve the forcing of the resin adhesive into the cracks and crevices of the rock formation within the bore hole, and into the interstices between the individual steel strands of the shank cable, in order to optimize the resin's ability to adhere to both the bolt shank and the bore hole rock formation. A second function of the dam 66 is to insure a uniform consistency of the resin adhesive along the entire length of the mine roof bolt shank 12 above the dam, with no air pockets, voids, or other nonuniform areas within the annulus between the bolt shank and the bore hole.

The inventor has determined that a preferred manner of retaining the dam 66 in the appropriate functional position along the bolt shank 12 is to utilize a conventional screw-type compression clamp 68 secured tightly to the shank cable at the appropriate location to prevent the dam 66 from slipping downwardly along the bolt shank either as the bolt is being inserted into the mine roof bore hole or as the resin adhesive is being mixed and "returning" downwardly in the annulus between the bolt shank and the bore hole wall under the force of the bolt's being inserted into the bore hole.

FIG. 8 illustrates yet a fourth alternative embodiment of the mine roof bolt of the present invention. This fourth embodiment incorporates the use of a stiffner sleeve 70, which takes the form of a metal pipe or cylinder. The stiffner sleeve has an inside diameter slightly larger than the outside diameter of the cable (a ⅝ inch inside diameter for a 0.600 diameter cable, for example), and an outside diameter that is essentially the same as the diameter of the borehole (one inch O.D. or one and ⅜ inches O.D., for example). Such an outside diameter the same as the diameter of the bore hole works quite well, inasmuch as, as a practical matter, the actual diameter of the bore hole is generally slightly larger than the indicated drill bit diameter, due to drill bit wobble, etc. The particular outside diameter of the stiffner sleeve 70 also permits the sleeve to fit inside the spherical washer 40 and directly against the hexagonal head collar 26.

As those skilled in the art can appreciate, the purpose of the stiffner sleeve 70 is two-fold. As a stiffner, it prevents the shank cable 12 from buckling as the cable bolt is being inserted into the bore hole, and as the blind end of the shank 12 "bottoms out" against the resin cartridges (not shown in FIG. 8). It should be appreciated that, as the blind end of the bolt shank 12 engages the resin cartridge(s), additional linear force is necessary for further inserting the bolt into the bore hole against the resistance provided by the resin cartridge(s). But for the stiffner sleeve 70, the bolt shank cable 12 could tend to buckle due to this additional linear force.

The second aspect of the stiffner sleeve 70 is that it is a "sleeve" around the shank cable that protects the shank cable from abrasive wear from the dome mine roof plate 44 as the cable bolt is rotated and spun during insertion into the bore hole. It can be appreciated that, but for the stiffner sleeve 70, spinning the bolt into the bore hole with the mine roof plate 44 loose causes the inside edge 46 of the mine roof plate to cut and wear into the outer surface of the peripheral steel strands 14 at the location on the shank cable where the mine roof plate "rides" as the bolt is being spun and inserted into the bore hole.

The inventor has determined that the length of the stiffner sleeve 70 can be anywhere from a minimum of approximately six inches to any desired functional length, typically 10 feet or more. This maximum length, of course, is relative to the overall mine roof bolt length, and may also be in part dictated by the amount (total length of cartridges) of resin adhesive inserted into the bore hole ahead of the mine roof bolt.

Figure 10:
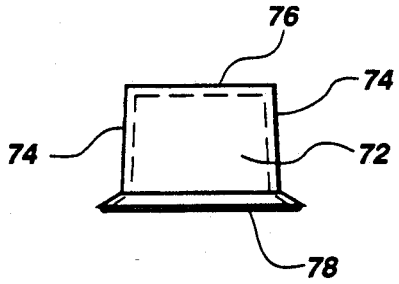
FIG. 10 is a side elevation view of a resin protector cap used with the mine roof bolt of the present invention.

FIG. 10 illustrates a shouldered resin protector plastic cap 72 that functions to (1) protect the resin cartridge from premature rupture as the blind end of the mine roof bolt is being utilized to insert and otherwise "ram" the resin cartridge into the bore hole, and (2) retain the resin cartridge in the blind end of the bore hole, as when subsequent resin cartridges are inserted into the bore hole sequentially.

As shown in FIG. 10, the shouldered resin protector cap 72 takes the form of a closed plastic cup that is sized to fit snugly on the end of the bolt shank cable. The resin protector cap 72 includes a cylindrical thin wall 74 having a closed end 76 that enables the resin protector cap to fit snugly on the end of the bolt shank cable. The protector cap 72 includes an annular shoulder 78 that is dimensioned to be slightly larger than the inside diameter of the bore hole.

Figure 11:
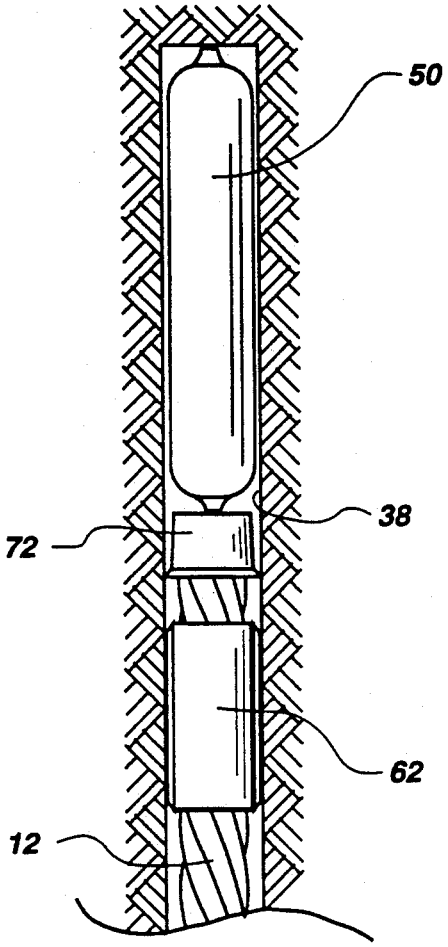
FIG. 11 is a partial side elevation view of the upper end of the mine roof bolt of FIG. 8 and incorporating the resin protector cap of FIG. 10, shown positioned in a mine roof bore hole prior to puncturing the resin cartridge.

When the resin protector cap 72 is inserted into the bore hole, the annual shoulder 78 is forced downwardly and functions as a one-way mechanism to permit the cap to travel only in one direction (up as shown in FIGS. 10 and 11), while essentially preventing movement in the opposite direction (down in the drawings). In this manner, when the resin protector cap 72 is placed on the end of the mine roof bolt shank 12 as shown in FIG. 11, and this combination (bolt shank and resin protector cap) is used to insert and urge a resin cartridge 50 up into the blind end of the bore hole, it should be apparent that the resin protector cap will remain in place and retain the resin cartridge in place within the bore hole after the bolt is withdrawn from the bore hole. Therefore, the mine roof bolt can be utilized as a plunging device to insert a plurality of resin cartridges into the bore hole in sequential fashion, each being protected from the sharp edges of the shank cable by the resin protector cap 72, then each being subsequently retained in position within the blind end of the bore hole by its own resin protector cap, and therefore prevented by the action of the downward direction of the annular shoulder 78 from slipping downwardly within the hole.

Figure 12:
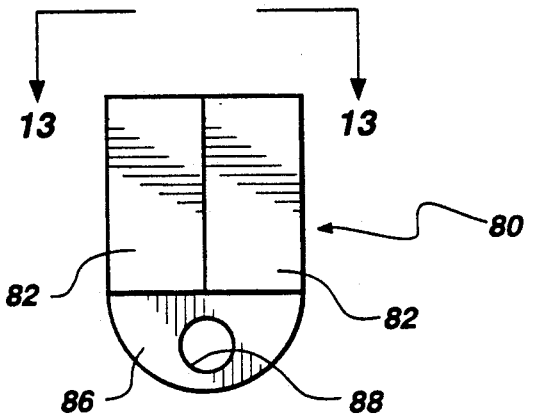
FIG. 12 is a side elevation view of a plastic hex-head cap sleeve for use with the mine roof bolt of the present invention.
Figure 13:
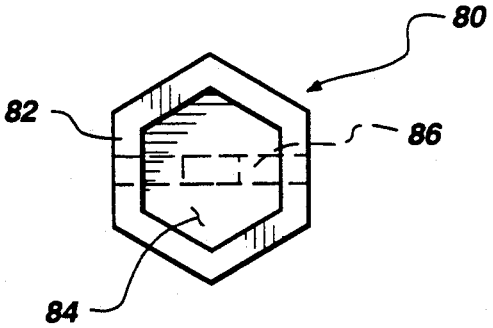
FIG. 13 is a top view of the plastic hex-head cap sleeve, taken along lines 13—13 in FIG. 12.

FIGS. 12 and 13 illustrate a hex head cap sleeve 80 for use with a plurality of mine roof bolts of the present invention. As shown, the hex-head cap sleeve 80 comprises a hollow, blind hex-shaped closed wall "cylinder" 82 that is dimensioned to fit snugly over the hexagonal head collar 26 of the mine roof bolt. In a preferred embodiment, the closed wall cylinder 82 is approximately ¼ inch thick, as is the end section that defines the blind end 84.

A ¼ inch thick semi-circular wing 86 is formed with the outer edge of the blind end 84 of the cap sleeve, diametrically as shown in FIGS. 12 and 13. This semi-circular wing 86 includes a through hole 88, for use in indirectly attaching a plurality of hex-head cap sleeves together, as will be explained in greater detail hereinbelow with reference to FIG. 14.

Even though the cable mine roof bolt of the present invention is considerably stronger than a prior art solid steel shank bolt of comparable diameter, the cable mine roof bolt can eventually fail under sufficient force. When these cable bolts have actually failed in testing, failure of the cable shank has almost always been relatively close to the hexagonal head collar 26 where there is little or no resin adhesive. Almost consistantly, these cable mine roof bolts have failed in a stepped fashion, as illustrated in FIG. 7, and therefore, are generally retained in the bore hole by the cable strands remaining intact. Occasionally, however, the bolt shank fractures totally at once. When this occurs in a mine tunnel, the broken end of the bolt frequently falls out of the bore hole to the tunnel floor, where it becomes an obstacle to men and equipment. And occasionally when the bolt fails in total, the tapered plug "pops" loose from the hexagonal head collar and cable, both the plug sections and collar separating from the cable, further complicating the situation.

Figure 14:
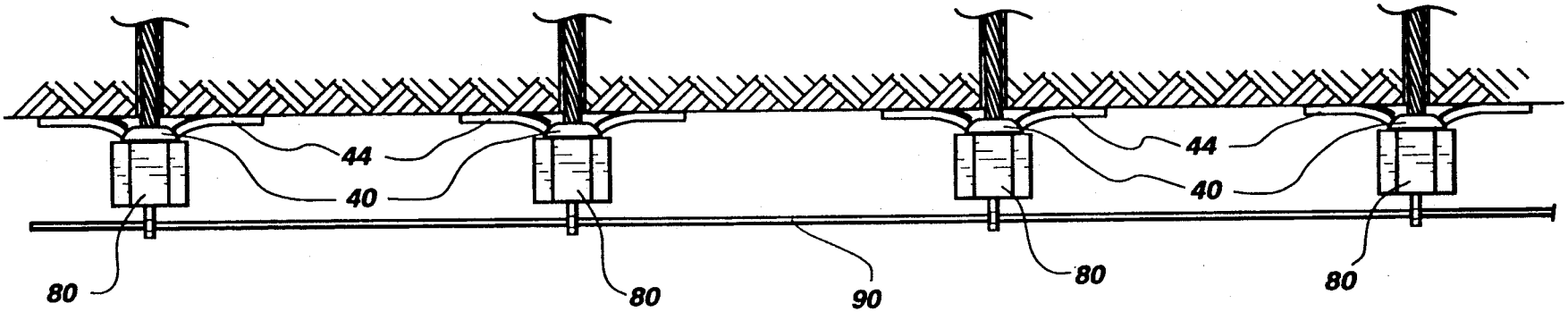
FIG. 14 is a side elevation view of a number of mine roof bolts installed in bore holes in a mine tunnel roof, illustrating the concept of the wire interconnecting the plastic hex-head cap sleeves of adjacent mine roof bolts.

With this background in mind, FIG. 14 illustrates a plurality of mine roof bolts interconnected in functional position within a mine roof. Each of the bolt hexagonal head collars 26 has affixed thereon a hex-head cap sleeve 80. A suitably strength steel wire 90 is passed through the through holes 88 of each hex-head cap sleeve in a manner to interconnect the cap sleeves, and therefore the hexagonal head collars 26 of adjacent mine roof bolts in order to retain the broken bolt within the bore hole, and thereby, prevent or at least minimize the detrimental effect of the broken cable bolt's falling to the tunnel floor when it breaks.

Those skilled in the art will readily appreciate that a plurality of mine roof bolts can be interconnected with a suitable steel wire 90 in continuous patterns that insure that all hex-head cap sleeves 80 are interconnected to at least two adjacent mine roof bolts, so that in the event any bolt within the pattern breaks, the fractured section of broken bolt will be constrained to movement limited by the taughtness of the interconnecting wire 90 and the broken bolt's proximity to the two adjacent interconnecting bolts within the wire pattern.

As one can appreciate, a downward force at the location of any mine roof bolt results in essentially only a lateral force at each of the adjacent bolt hex-head cap sleeves 80, and only a lateral force at each of the remaining hex-head cap sleeves. Because of these lateral only forces, the inventor has determined that it is extremely unlikely that a broken mine roof bolt's falling out of the bore hole would cause the hex-head cap sleeves 80 of adjacent bolts to be pulled off of their respective bolt heads. This is because the force necessary to remove a hex-head cap sleeve 80 from a hexagonal bolt head collar should be axial, and that the forces created by the broken bolt are essentially transverse, thereby effectively operating to "bind" the hex-head cap sleeve 80 more tightly onto its corresponding hexagonal head collar 26.

Figure 15:
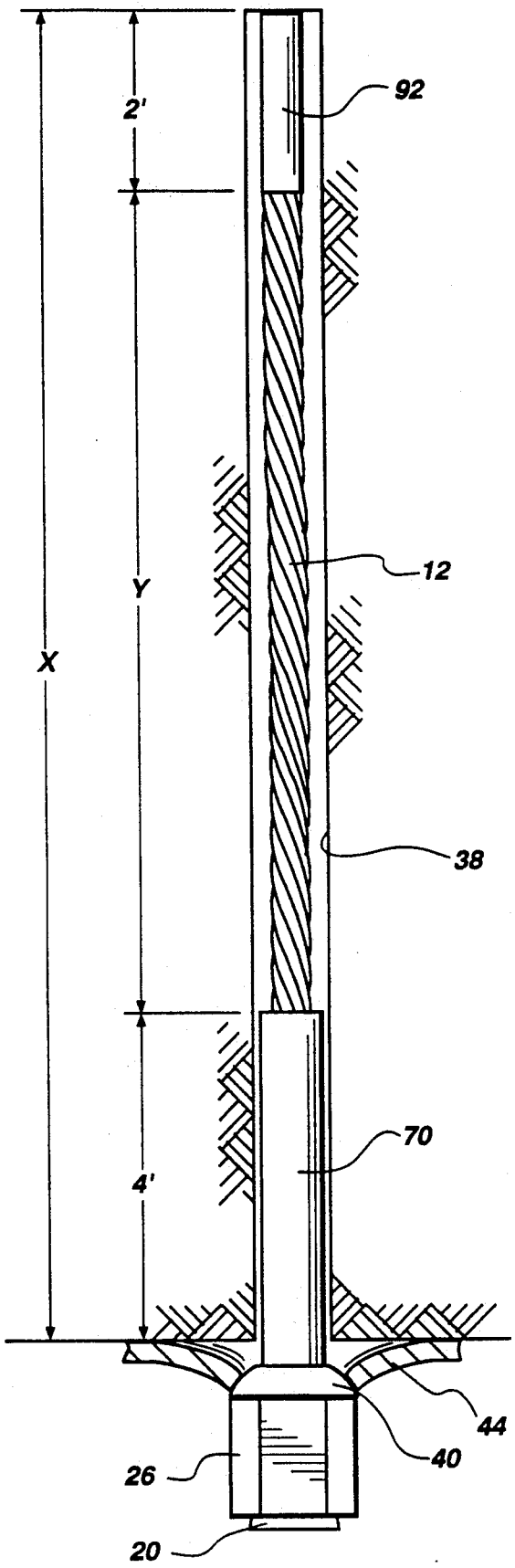
FIG. 15 is a side elevation view of another alternative embodiment of the mine roof bolt of the present invention, illustrating the yieldable concept of the mine roof bolt.

FIG. 15 illustrates a fifth embodiment of the mine roof bolt of the present invention. The mine roof bolt of FIG. 15 is what is called in the industry a yieldable bolt, in that it is designed to slip or "yield" within the bore hole under substantial force, rather than fail and end up supporting nothing. In some mine roof bolting systems, it is possible for each mine roof bolt to slip within the bore hole a certain amount. This slippage may be either between the bolt shank 12 and the resin adhesive surrounding the shank, or may be between the resin adhesive and the interior wall of the bore hole. In either event, the retaining force of the resin adhesive against the bolt shank is a direct function of the length of direct attachment of the resin adhesive with the bolt shank. Therefore, as the bolt shank slips out of the resin adhesive, this length of direct attachment is decreased, and the retaining force of the resin adhesive within the bore hole to retain the bolt shank decreases directly in proportion. For example, assume that a ten foot mine roof bolt is completely surrounded by hardened resin adhesive. In the event that shifting in the rock formation causes the bolt to "slip" downwardly one foot, the result is that only nine feet of the ten foot bolt shank would now be retained in the resin adhesive within the bore hole, resulting in only 90% of the original resin adhesive bonding force retaining the bolt shank in the bore hole.

It would be preferable to utilize a mine roof bolt that maintained a consistent resistance force along the entire ten foot length of the bolt shank, even after the bolt had "slipped" within the bore hole and otherwise out of the bore hole by a small amount. This fifth embodiment of FIG. 15 accomplishes this result by in effect "extending" the length of the bolt shank into an area in which the bolt shank is not bonded to the resin adhesive along the "extended" portion of the bolt shank. This is accomplished by covering the extended end of the bolt shank with a material that prevents the resin adhesive from bonding to the "extended" end of the bolt shank, so that the distance along the bolt shank that is in actual and continuous contact with the resin adhesive remains the same, even as the bolt "slips" relative to the resin adhesive within the bore hole.

This concept is explained with reference to FIG. 15. A bore hole is drilled to a depth of X. A mine roof bolt of this same length, X, includes a cover material 92 that covers the blind end of the bolt shank 12 down for a distance of approximately two feet from the end of the shank. This particular structure of FIG. 15 also includes a stiffner sleeve 70 that is four feet in length. Therefore, as shown in FIG. 15, the length of exposed shank cable 12 is $Y=X-6$ feet. This distance, Y, is the length of shank cable that will have the resin adhesive tightly fitted into the annulus around the bolt shank and into the rock formation for resin bonding the mine roof bolt in the bore hole. Although the two foot length of bolt shank at the blind end will also have resin adhesive material forced into the annulus therearound, the cover material 92 prevents the resin adhesive from bonding to the very end two foot section of the bolt shank. As the mine roof bolt "slips" out of the bore hole, the gripping length, Y, of the bolt shank 12 in the resin material remains the same, even though the bolt "slips" up to a maximum of two feet within the bore hole. In this manner, this "yieldable concept" of the mine roof bolt of the present invention permits the bolt to "yield" within the bore hole a certain specified amount while maintaining constant the resistance force that retains the bolt within the bore hole.

It should be obvious to those skilled in the art that the improved mine roof bolt of the present invention, not utilizing mine roof bolt shank couplers, does not require an overly large bore hole in the mine tunnel roof. Therefore, less potential damage is done to the structural integrity of the rock formation above the mine tunnel. Additionally, less resin adhesive is required in the bore hole, and therefore the resin that is in the bore hole is more effective. Also, the improved mine roof bolt, not utilizing bolt shank couplers, does not have the problem of bolt or coupler fracture when the mine roof rock formation shifts.

The improved mine roof bolt, not utilizing bolt shank couplers, facilitates complete mixture of the resin material and complete distribution of the resin material along the total length of the mine roof bolt shank and mine roof bore hole wall, if desired.

Inasmuch as the improved mine roof bolt of the present invention is constructed of a multi-strand cable rather than a solid shank, the mine roof bolt will bend sufficiently to follow the path of an irregular bore hole. The multi-strand, flexible cable mine roof bolt can also be bent to facilitate installation into a bore hole that requires a roof bolt that is considerably longer than the height of the mine tunnel a the location of the bore hole, and will also bend rather than break, when the mine roof rock formation shifts.

From the foregoing it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A mine roof bolt comprising:

(a) a length of multi-strand cable defining a bolt shank;

(b) a tapered plug comprising a body portion having an internal bore and a frusto-conical outer surface essentially concentric with said internal bore, said tapered plug being mounted about an end of said cable at said internal bore;

(c) an internally tapered drive collar having a frusto-conical inner surface that engages said frusto-conical outer surface of said tapered plug, and having an outer surface defining a drive head that accepts a driving mechanism for rotating and linearly translating said bolt, wherein said tapered plug is mounted on an end of said cable, and said drive collar is pressed down upon said tapered plug, forcing said tapered plug against said cable, such that said drive collar, said tapered plug, and said cable, when fitted tightly together, define said mine roof bolt; and (d) a sleeve attached to said cable for preventing said cable from slipping relative to resin adhesive material within a bore hole, said sleeve having radially outwardly projecting fins oriented axially relative to said sleeve for centering said sleeve and said cable within the bore hole and for puncturing resin adhesive cartridges.

2. A mine roof bolt as set forth in claim 1, wherein said multi-strand cable comprises a plurality of steel strands spirally wrapped around a central steel strand.

3. A mine roof bolt as set forth in claim 1, wherein said tapered plug comprises two essentially diametrically opposed semi-frusto-conical tapered plug sections.

4. A mine roof bolt as set forth in claim 3, wherein each of said tapered plug sections includes a serrated internal bore defining a knurled semi-tubular surface.

5. A mine roof bolt as set forth in claim 4, wherein the serrations of said serrated internal bore are circumferential.

6. A mine roof bolt as set forth in claim 4, wherein the serrations of said serrated internal bore are angular, defining a diamond pattern.

7. A mine roof bolt as set forth in claim 1, wherein said outer surface of said drive collar defines a hexagonal head essentially concentric with said frusto-conical inner surface.

8. A mine roof bolt as set forth in claim 1, wherein said drive collar includes a semi-spherical washer surface on one end thereof.

9. A mine roof bolt as set forth in claim 1, wherein said sleeve is swaged onto said cable.

10. A mine roof bolt as set forth in claim 1, wherein said sleeve is cylindrical and wherein said fins are oriented across the diameter of said sleeve.

11. A mine roof bolt as set forth in claim 1, further comprising a dam for maximizing the amount of resin adhesive that is concentrated within the blind end of the bore hole around said multi strand cable.

12. A mine roof bolt as set forth in claim 1, further comprising stop means for retaining said dam in a predetermined location on said cable.

13. A mine roof bolt as set forth in claim 1, further comprising a cap sleeve for mounting on said drive collar, said cap sleeve having a connecting means for interconnecting a plurality of cap sleeves.

14. A mine roof bolt as set forth in claim 13, wherein said connecting means comprises a flange formed with said cap sleeve and a connecting wire passing through said flange.

15. A mine roof bolt comprising:

(a) a length of multi-strand cable defining a bolt shank;

(b) a tapered plug comprising a body portion having an internal bore and a frusto-conical outer surface essentially concentric with said internal bore, said tapered plug being mounted about an end of said cable at said internal bore;

(c) an internally tapered drive collar having a frust-conical inner surface that engages said frusto-conical outer surface of said tapered plug, and having an outer surface defining a drive head that accepts a driving mechanism for rotating and linearly translating said bolt, wherein said tapered plug is mounted on an end of said cable, and said drive collar is pressed down upon said tapered plug, forcing said tapered plug against said cable, such that said drive collar, said tapered plug, and said cable, when fitted tightly together, define said mine roof bolt; and (d) a stiffner sleeve mounted on said cable adjacent said drive collar for minimizing buckling of said cable as said mine roof bolt is being inserted into a bore hole, and for protecting said cable from damage from a mine roof bolt plate as said mine roof bolt is being rotated into a bore hole.

* * * * *